United States Patent [19]

Friedman et al.

[11] 4,227,170

[45] Oct. 7, 1980

[54] CURRENT-REDUCING DEVICE

[75] Inventors: Moshe Friedman, Washington, D.C.; Michael G. Ury, Bethesda, Md.

[73] Assignee: The United States of America as represented by the Secretary of the Navy, Washington, D.C.

[21] Appl. No.: 808,839

[22] Filed: Jun. 22, 1977

[51] Int. Cl.[3] ..... H01H 85/02

[52] U.S. Cl. ..... 337/204; 337/114; 337/277

[58] Field of Search ..... 337/204, 277, 114; 361/435

[56] References Cited

U.S. PATENT DOCUMENTS

| | | | |
|---|---|---|---|
| 3,710,295 | 1/1973 | Staub et al. | 337/204 |
| 3,851,290 | 11/1974 | Stover et al. | 337/204 |

*Primary Examiner*—Harold Broome

*Attorney, Agent, or Firm*—R. S. Sciascia; Philip Schneider

[57] ABSTRACT

A current-reducing device (fuse or switch) is described comprising a foil member of Al or Mg which is immersed in a fluid with which it will chemically react (such as $H_2O$ or $H_2O_2$) above a certain temperature. The foil member is an electrical conductor but becomes an electrical insulator as a result of the chemical reaction.

6 Claims, 5 Drawing Figures

$\ell = 37$ cm
$L \approx 250\ \mu H$
$V_0 = 6.6$ kV
IN ALL CASES

CURRENT-REDUCING DEVICE

BACKGROUND OF THE INVENTION

This invention relates to current-reducing devices and especially to modifiable-conductive-state, thin foil devices.

The need for fuses which rapidly interrupt the flow of current in a circuit when the current rises above a given value and the present scientific interest in high-power electrical pulses with energy greater than 10 megajoules has led to research in inductive storage systems. In such systems, electrical energy is stored in an inductor, L, thru which current is flowing. The energy is switched into a load by opening a switch in series with the inductor. This interruption in current causes the inductor to generate a voltage which appears across the switch. The switch must be able to withstand very high inductive voltages to rapidly dissipate the energy in the inductor.

Opening switches commonly employed consist of a metallic wire or a file-type fuse. When sufficient energy is dissipated in the fuse, it explodes and its resistance can increase by many orders of magnitude (preferably, the resistance becomes infinite). This change in the electrical resistance of the fuse causes the desired current discontinuity.

However, these fuses act comparatively slowly and tend to ionize upon vaporization, which results in a restrike. The present invention greatly increase the speed of operation of a foil fuse and eliminates or greatly decreases the possibility of restrike. It also permits the generation of higher inductive voltages across the fuse.

SUMMARY OF THE INVENTION

The advantages of the present invention are provided by immersing a modifiable-conductive-state element comprising a fuse in a non-conductive fluid. The modifiable-conductive-state element is fabricated from an electrically conductive material which will react chemically with the fluid at a certain temperature, the reaction changing the conductive element to insulative element.

DETAILED DESCRIPTION OF THE INVENTION

Figure 1:
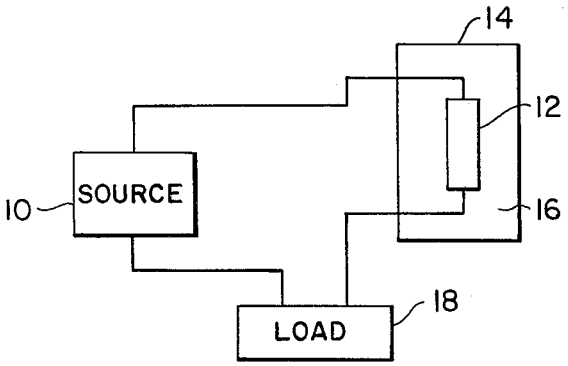
FIG. 1 is a schematic block diagram of the invention in a typical circuit.

FIG. 1 shows a block diagram of the invention connected in an electrical circuit. The invention is a fuse-like member comprising a modifiable-conductive state (MCS) member 12 immersed in a fluid 16 which is within a suitable container 14. The fuse-like member is connected between a source 10 of electrical energy and its load 18.

To act as a fuse, the invention must be able to carry the circuit current until a critical value is reached and must act as a high resistance (preferably infinite resistance) when the circuit current rises above the critical value. Theoretically, the change in its resistance from a low to a high value should occur instantaneously.

The MCS member 12 is preferably a rectangular piece of metal, such as Al or Mg, and the fluid 16 is a material, such as $H_2O$ or $H_2O_2$, which reacts chemically with the material of the MCS member to transform it into an electrical insulator.

The operation of the invention is thought to be as follows: Current flows thru the Al MCS member 12 and heats it. Part of the heat is dissipated by the fluid 16. As the current rises, the temperature of the MCS member increases until the temperature reaches the ignition value $T_i$. The ignition value is the lowest temperature at which a chemical reaction between Al and $H_2O$ occurs.

When the Al reacts with the $H_2O$, a much greater amount of heat is generated, causing the chemical reaction to proceed at a very rapid rate. The result of the chemical reaction is to turn the Al into $Al_2O_3$ (aluminum oxide) which is an electrically insulative material, i.e., a material with a very high resistance. This causes the current to drop to a very low, or zero, value. The $Al_2O_3$ then disintegrates and the resistance becomes infinite.

Figure 2:
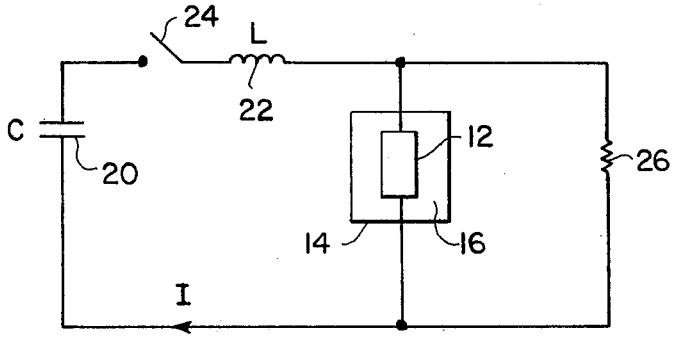
FIG. 2 is a circuit schematic showing the use of the invention as a current interrupter, or opening switch, in an inductive circuit.

Consider now the circuit shown in FIG. 2. The initial charge on a capacitor bank 20 is used to "charge" inductive store 22 by closing switch 24. The charging current, I, flows thru the MCS member 12 heating it until the chemical reaction occurs which changes it to an insulator. The MCS member 12 then effectively opens the circuit, switching the energy to the load 26. The fuse-like member 14 in this case acts as an opening switch the relative performance of which can be measured by a quality factor a which is measured by the following equation:

$$\alpha = \frac{t_c}{\sqrt{T_{\frac{1}{2}}\left(\frac{L}{R_m}\right)}} \tag{1}$$

where $t_c$ is the charging time of the inductor prior to fuse explosion, $T_{\frac{1}{2}}$ is the width of the resultant voltage pulse, and $R_m$ is the resistance of the switch at the maximum voltage. A value of $\alpha$ as high as 10 has been reported, but only at output voltages of 12 kV.

Figure 3:
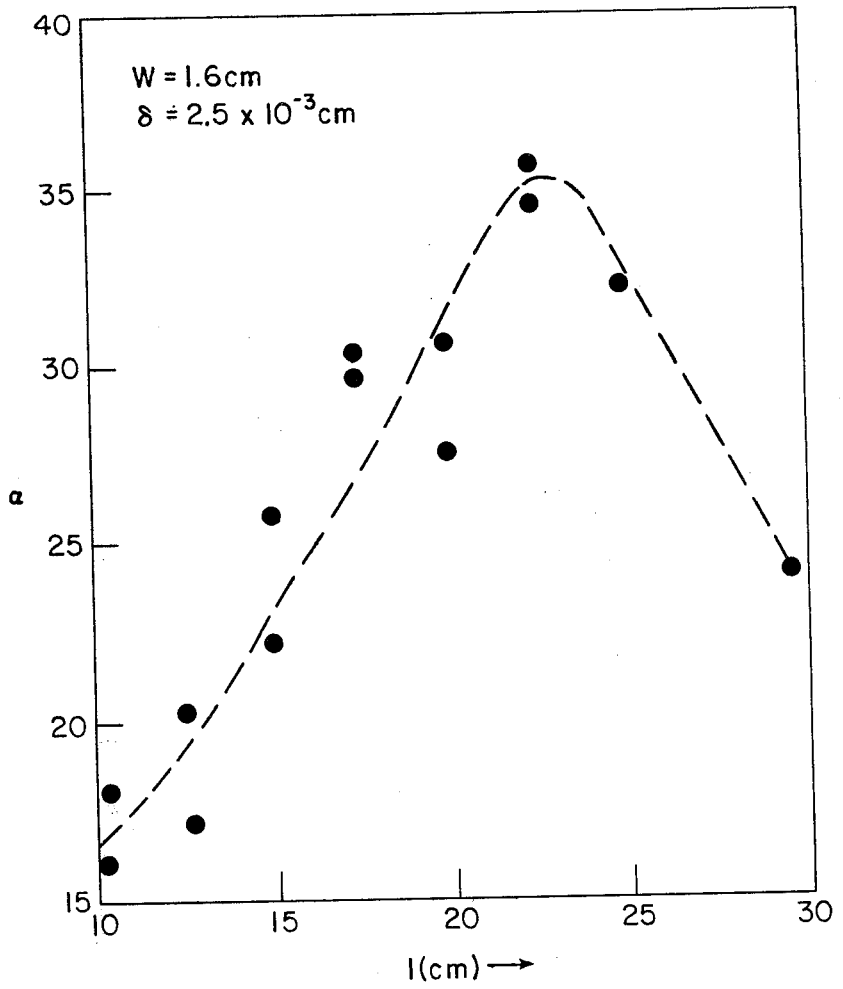
FIG. 3 is a plot showing the effect of the length of a foil fuse on its resistance.

With the fuse-like member described herein, values of $\alpha \gtrsim 30$ were obtained and voltages of 100 kV generated across the opened switch. The capacitor bank, C=300 $\mu$F, was connected to either a 12, 250 or 400 $\mu$H inductor, L. A metallic foil or fuse, immersed in a demineralized water bath, completed the electrical circuit. A Rogovsky coil and a resistive divider measured the current flowing in the system and the voltage developed across the foil. Aluminum foils of various length, l, thickness, $\delta$, and width, w, were used. In addition, Mg foils were also used. FIG. 3 shows typical current and voltage traces for a reasonably optimal choice of Al foil.

Since $\alpha$ depends on $R_m$ it is obvious that a greater value of l gives larger values of $R_m$ and $\alpha$. For example, FIG. 3 shows the dependence of $\alpha$ on l. The performance of different materials used as a switch foil can be judged from the value of $\alpha$, and Al was found to be better than Mg.

Figure 5:
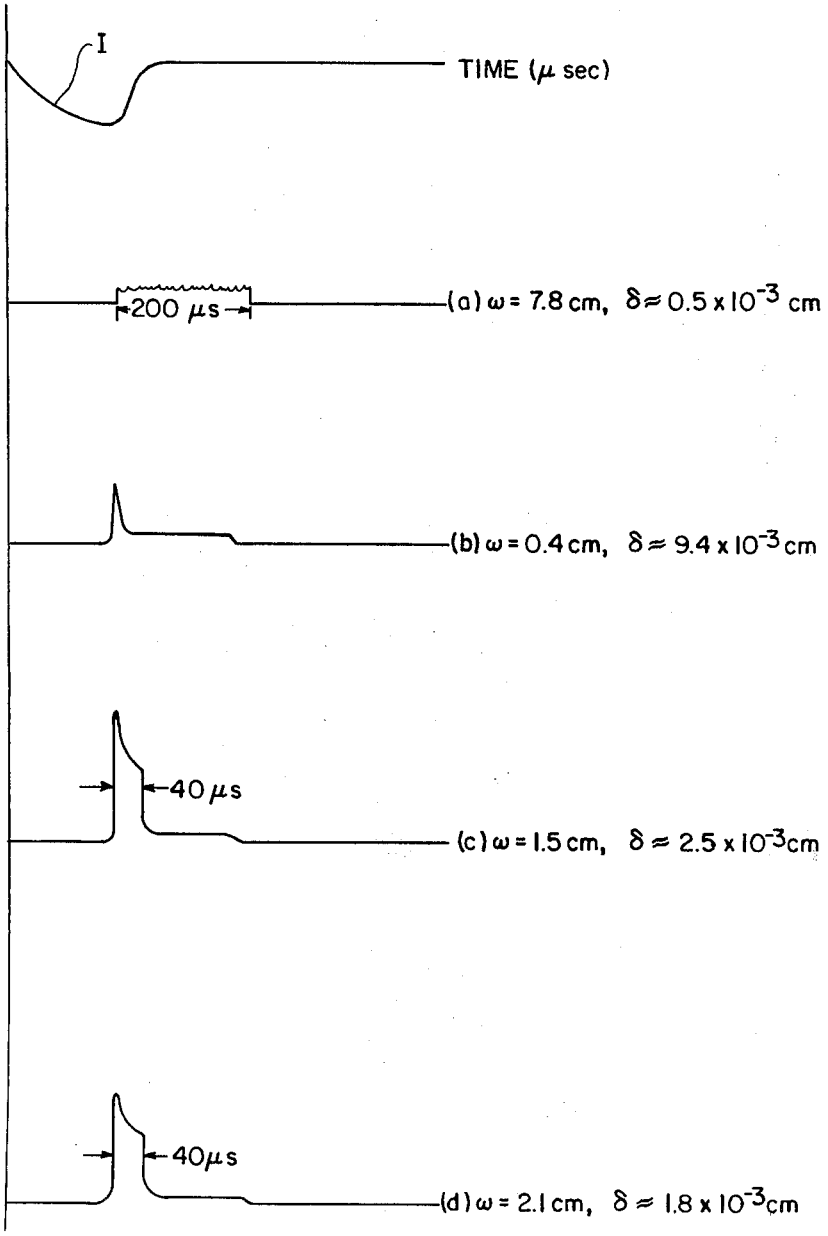
FIG. 5 a–d are plots of voltage versus time for fuses having different dimensions.

Four different Al foils with the same cross-sectional area were tested. Each of them had a different width and thickness. FIG. 5 shows the voltage developed across each of these fuses. When a very wide foil was used (FIG. 5*a*) the fuse never reached high values of resistance and voltage. When the foil resembled a wire (FIG. 5*b*) the resistance reached initially a high value but immediately dropped (restrike). When foils used were of width which fell between the previous two extremes (FIG. 5*c* and 5*d*), resistance and voltage reached and maintained high values.

The switch performance was improved when hydrogen peroxide ($H_2O_2$) was added to the water immersing the switch. For example an increase in voltage by a factor of two was observed when 70% $H_2O_2$ was used.

Figure 4:
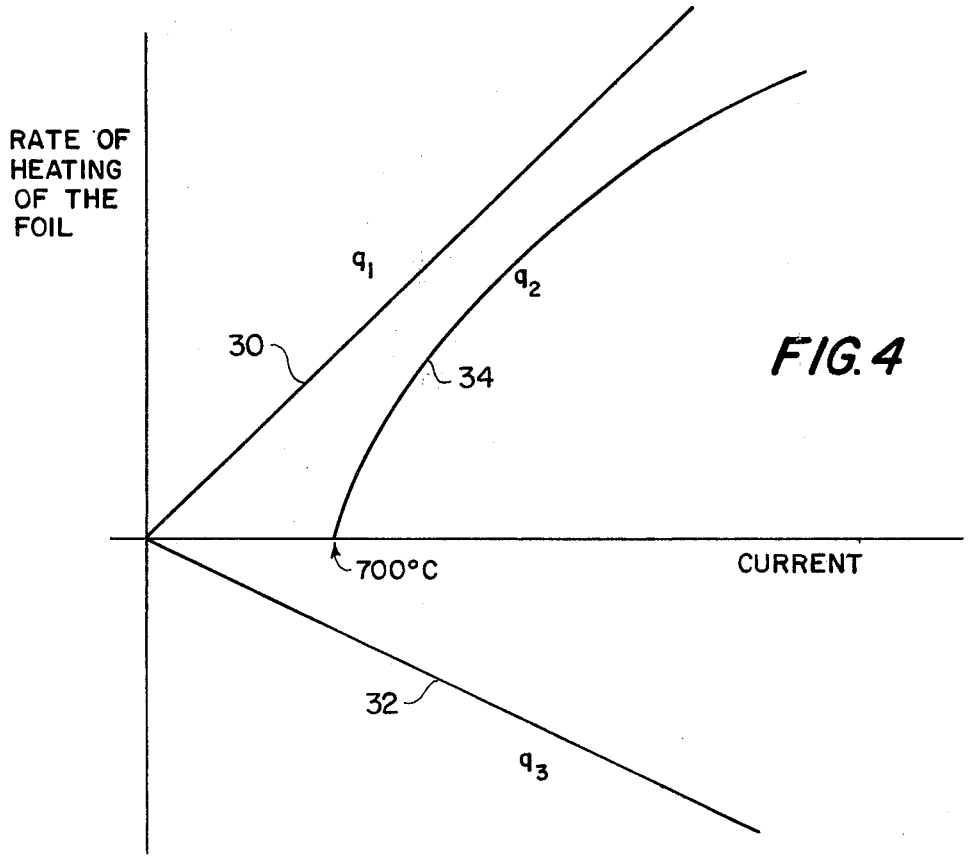
FIG. 4 is a generalized plot showing various types of heating and cooling which occur in the invention. (The curves shown are not intended to be accurate representations of the actual curves but are for explanatory purposes only.)

Relationships developed by Maisonnier, Linhart and Courlan, Review of Scientific Instruments 37, 1380 (1966), for the condition of foil (rectangular fuse) vaporization at peak current, define a foil cross-sectional area, s, as:

$$s = w\delta = \left( \frac{(\frac{1}{2} CV_o^2)^{3/2}}{V_o L^{\frac{1}{2}} K_1 a} \right)^{\frac{1}{2}}, \tag{2}$$

where a is a constant characteristic of the material of the foil and $1<k_1<3$. This relation was developed for a circuit where a capacitor of value C feeds its energy to a coil of value L, $V_o$ being the initial potential of the capacitor, and w and $\delta$ being the width and thickness of the foil, respectively. Maisonnier, et al. do not explain the behavior of the fuse after vaporization, especially the time behavior of the resistance. The experimental results described earlier suggest that mechanisms other than ohmic heating may play an important role when a metallic foil is exploded under water. It is thought that two processes in addition to the ohmic heating 30 have to be considered (see FIG. 4): (1) a heat loss from the foil to the water 32 and (2) heating (34) from a chemical reaction between the material of the fuse and the water. In that case the internal energy of the foil, e, is governed by an equation of the form $$M\frac{de}{dt} \approx q_1 + q_2 - q_3, \tag{3}$$

where $q_1$ is the rate of ohmic heating $$q_1 = I^2 \frac{\rho(T)l}{w\delta}, \tag{4}$$

$\rho(T)$ is the resistivity of the foil at temperature T, $q_2$ is the rate of chemical heating and is proportional to $$q_2 \sim w\,lT^{\frac{1}{2}} \exp(-A/T). \tag{5}$$

This dependence was obtained from kinetic theory. The parameter A depends on the threshold temperature of the reation. For example the threshold temperature of the reaction $$2\,Al + 3H_2O \rightarrow Al_2O_3 + 3H_2 \tag{6}$$

is about 700° C. The chemical reaction rate of energy gain, $q_2$, depends on the energy released by the chemical reaction. The higher the energy released, the larger $q_2$ is. The chemical reaction described by Eq. (6) gives 15 kJ/gm. Less energy is released when Mg is used. The quantity $q_3$ (Eq. 4) is the rate of heat loss to water and is given approximately by $$q_3 \approx \lambda \frac{dm_2}{dt} \approx \lambda 2\,\rho_d wlV_s, \tag{7}$$

where $\lambda$ is the heat of vaporation of water, $m_2$ is the mass of water vaporized, $\rho_d$ is the density of water and $V_s$ is the escape velocity of steam bubbles from the foil. If one assumes that the force which ejects the steam bubbles from the foil depends on gas pressure within the bubble and that only viscous forces oppose the motion of the bubbles in the liquid, then $$V_s \sim T \text{ or } q_3 \sim wl\,T.$$

Each of the above processes can be predominant during different times of the current cycle. At the initial stage when R and I both increase with time, $q_1>q_3$ and $q_2\approx 0$. At a certain time, the current does not change very much and the resistance stays constant (although the temperature of the foil increases). Since $q_3 \sim wlT$, it is possible by choosing a large w (and a small $\delta$) to increase $q_3$ without changing $q_1$ and to have $q_3 \approx q_1$. This will define an "equilibrium" temperature, $T_1$. If $T_1$ is below the temperature of foil vaporization and $q_2 \approx 0$, no explosion will occur and the energy in the inductive store will dissipate gently into the water (FIG. 5*a*). If $T_1$ is above the ignition point of the chemical reaction, then $q_2>0$. In that case the temperature of the fuse will increase. Since $q_2 \sim wl\sqrt{T}$ and $q_3 \sim wl\,T$ (for large T), the foil will reach an "equilibrium" temperature $T_2$ for which $q_1+q_2 \approx q_3$. If $T_2$ is below the temperature for which ionization occurs, the foil will change its characteristics from a conductor (e.g., Al) to an insulator (e.g., $Al_2O_3$) and a successful switching will occur (FIG. 5*c* and 5*d*). If w is small so that $q_3$ is always smaller than $q_1$, the temperature of the fuse will increase to a value for which ionization may start (FIG. 5*b*).

In order to convert the conductor to an insulator as fast as possible, the chemical reaction has to rapidly supply a great deal of energy. The amount of energy released depends on the material of the fuse. The ranking of Al and Mg (based on the chemical reaction heat which is released) is in that order respectively. This is exactly the same ranking obtained experimentally based on the switch quality factor $\alpha$. Moreover, by using Al foil immersed in $H_2O_2$ more chemical energy can be released with an improved switch performance.

Thus, it is apparent that thin Al foils immersed in water have improved characteristics as fuses, or opening switches, in an inductive circuit. The improvement is thought to be due to the process of heat losses through the water bath, and a chemical reaction of the Al foil with water. Such foils have additional application as short, high-voltage pulse generators.

The invention effectively uses chemical energy to change the state of the MCS element from conductive to insulative; uses chemical energy to decrease the transition time between the conductive and insulative states, thus producing a greater rate of change in current (dI/dt) and higher voltage pulses; and uses the fluid medium to cool the MCS element during the opening stage thereby preventing ionization of the element and a restrike.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A current-reducing device comprising:

a modifiable-conductive-state (MCS) member; and a volume of fluid, said MCS member being immersed in said fluid, said MCS member being fabricated from an electrically conductive material and said fluid being a material which is substantially electrically non-conductive, said member and said fluid being of materials which chemically react exothermically with each other at a predetermined temperature to convert the MCS member to an electrical insulator.

2. A device as in claim 1, wherein said MCS member is formed from Al.

3. A device as in claim 1, wherein said MCS member is formed from Mg.

4. A device as in claim 1, wherein said fluid is $H_2O$.

5. A device as in claim 1, wherein said fluid is $H_2O_2$.

6. A device as in claim 1, wherein said MCS member is formed from an element taken from the group consisting of Al and Mg and said fluid is a fluid taken from the group consisting of $H_2O$ and $H_2O_2$.

* * * * *